US008154397B2

(12) United States Patent
Astrin

(10) Patent No.: US 8,154,397 B2
(45) Date of Patent: Apr. 10, 2012

(54) LOCKING MECHANISM, SYSTEMS AND METHODS FOR CARGO CONTAINER TRANSPORT SECURITY

(76) Inventor: Arthur W. Astrin, Palo Alto, CA (US)

( * ) Notice: Subject to any disclaimer, the term of this patent is extended or adjusted under 35 U.S.C. 154(b) by 750 days.

(21) Appl. No.: 11/414,479

(22) Filed: Apr. 28, 2006

(65) Prior Publication Data

US 2006/0250235 A1 Nov. 9, 2006

Related U.S. Application Data

(60) Provisional application No. 60/678,454, filed on May 4, 2005.

(51) Int. Cl.
*G08B 26/00* (2006.01)

(52) U.S. Cl. ..... 340/505; 340/431; 340/539.1; 340/539.11; 340/539.13

(58) Field of Classification Search ..... 340/431, 340/539.1, 539.11, 539.13
See application file for complete search history.

(56) References Cited

U.S. PATENT DOCUMENTS 5,804,810 A * 9/1998 Woolley et al. ..... 235/492
7,012,529 B2 3/2006 Sajkowsky ..... 340/572.1
2004/0178880 A1 * 9/2004 Meyer et al. ..... 340/5.22
2005/0083172 A1 4/2005 Bates
2005/0088299 A1 4/2005 Bandy et al.
2008/0256991 A1 * 10/2008 Goldman ..... 70/57.1

OTHER PUBLICATIONS

Tomas Kellner, *Thanks, Dubai!*, FORBES Magazine, Mar. 27, 2006, vol. 177, No. 6, pp. 47-48.
PCT Application No. PCT/US2006/016483, International Search Report and Written Opinion dated Aug. 9, 2007.
PCT Application No. PCT/US2006/016483, International Preliminary Report on Patentability dated Nov. 15, 2007.

* cited by examiner

*Primary Examiner* — Daryl Pope
(74) *Attorney, Agent, or Firm* — Henneman & Associates, PLC; Larry E. Henneman, Jr.

(57) ABSTRACT

A system comprises a network of sensors inside a cargo container, each sensor capable of generating sensor information pertaining to the environment within the cargo container; an operation center; and a device (e.g., a lock) outside of the cargo container capable of communicating with the network of sensors (possibly using a wireless standard) and with the operation center (possibly using a satellite or cellular network), capable of receiving the sensor information, and capable of reporting a message based on the sensor information to the operation center. The sensor network may include an arrangement of temperature sensors, humidity sensors, radioactivity sensors, chemical/biological toxin sensors, chemical explosive sensors, vibration sensors, sound sensors, collision sensors, and/or light sensors. The device may include a communication module capable of communicating with other device on other containers. The operation center may monitor messages received from the devices to determine proper responses.

19 Claims, 10 Drawing Sheets

LOCKING MECHANISM, SYSTEMS AND METHODS FOR CARGO CONTAINER TRANSPORT SECURITY

PRIORITY CLAIM

This application claims benefit of and hereby incorporates by reference provisional patent application Ser. No. 60/678,454, entitled "Container Security System Architecture," filed on May 4, 2005, by inventor Arthur W. Astrin.

TECHNICAL FIELD

This invention relates generally to cargo container security, and more particularly provides a locking mechanism, systems and methods for cargo container transport security.

BACKGROUND

Cargo containers, e.g., intermodal containers, are commonly used to ship goods from one location to another. Goods are packed into the cargo container, and the doors are closed and latched. Then, the cargo container is transported to its destination by a transport vessel, such as a truck, plane, train or ship. At the destination, the container doors are unlatched and opened, and the goods are removed.

In the United States alone, in 2001, approximately 16 million cargo containers arrived within the United States by ship, truck and railroad. In 2001, the United States Customs processed approximately 214,000 vessels carrying approximately 5.7 million cargo containers. Globally, over 200 million cargo containers move between various seaports per year.

The National Cargo Security Council has estimated that, as of 1998, annual cargo theft in the United States cost approximately $10 billion per year, which after adjustment for inflation is approximately five times higher than 20 to 25 years ago. This estimate reflects only the value of the lost goods. When the cost of incident investigations, insurance paperwork and insurance claims are taken into account, the actual annual business impact of cargo theft is estimated to be between $30 billion and $60 billion per year.

It should be noted that most theft goes unnoticed until final delivery, due in part to the nature of multimodal transportation. By the time of delivery, backtracking to the point of loss is often difficult or impossible.

The need for more secure methods of shipping goods in the United States became apparent after the large scale national security breach on Sep. 11, 2001. At that time, United States Customs and others responsible for monitoring the shipment of goods into the United States relied primarily on printed documentation and visual inspection of the cargo itself. Systems for tracking cargo as it traveled were essentially nonexistent. Further, there was no way of inspecting the contents of a shipping container without opening the container and risking that the cargo is dangerous. Developments after Sep. 11, 2001 include changing from paper to electronic booking and manifests, using gamma- and x-ray scanners to examine container contents without opening them, and creating portals on which authorized users can track shipping information. Even with these new developments, inspectors are still unable to tell what is in a container without making a visual inspection of the container, and unable to track the contents of shipments during transit without intrusive inspection.

Currently, United States Customs thoroughly screens and examines all shipments deemed to potentially pose a risk to United States security. The goal of United States Customs is to screen these shipments before they depart for the United States whenever possible. To do so, Customs receives electronic bill of lading/manifest data for approximately 98 percent of the sea containers before they arrive at U.S. seaports. Customs uses this data to first identify the lowest risk cargo being shipped by long-established and trusted importers. In the year 2000, nearly half a million individuals and companies imported products into the United States. But 1,000 companies (the top two tenths of one percent) accounted for 62 percent of the value of all imports. Some shipments for these companies are still randomly inspected, but the vast majority is released without physical inspection.

One advancement in security includes the Container Security Initiative (CSI). Started by the Customs Service in early 2002, CSI puts teams of Customs professionals in ports around the world to target containers that may pose a risk for terrorism. CSI lays out goals including: intensifying targeting and screening of containers at ports worldwide, before the containers are loaded and sent to their final destinations; including national security factors in targeting; providing additional outreach to United States industry for cooperation, idea generation, and data collection; establishing security criteria for identifying containers that may pose a risk for terrorism, based on advance information; pre-screening containers at the earliest possible point using technology to quickly pre-screen containers that may pose a risk for terrorism; developing secure and "smart" containers; significantly increasing ability to intercept containers that may pose a risk for terrorism, before they reach United States shores; increasing the security of the global trading system; facilitating smooth movement of legitimate trade; protecting port infrastructures; enhancing safety and security for all; giving a competitive advantage to the trade; international reciprocity; insurance; deterrence.

The top twenty ports in the world, which handle approximately 70% of containers destined for the United States, are now participating in CSI. In cooperation with the host government, CSI teams work in the foreign country to identify and target high-risk containers for pre-screening. The host government then conducts the inspection while the CSI team observes. Low-risk and CSI pre-screened containers enter without additional delay unless more information dictates otherwise. CSI both increases security and facilitates flow of legitimate trade. Specific successes include important seizures at several CSI ports.

Current processes fail to provide the ability to monitor shipments, control their accessibility, and detect security breaches therein. They do not support a system that allows for the tracking of cargo in transit, the monitoring of cargo to ascertain cargo container integrity during transit, and to verify container contents without intrusive verification. A system and method are needed that allow for monitoring of shipments, monitoring of the actual contents of shipments, control of accessibility, and quick detection of potential security breaches.

SUMMARY

In one embodiment, a smart lock may facilitate locking and tracking of a container using wired or wireless sensor devices to monitor the state of the container, including the detection of container door tampering, undesirable temperature and humidity inside the container, accelerations and vibrations of the container, a variety of gas emissions and radiation, etc. Each sensor may be sensitive enough to detect problems anywhere inside the container. Additionally, the lock may receive GPS/Gallileo/Glosnass information and thus may maintain precise location information. The smart lock may determine when alarm conditions exist and may send encrypted data via low-powered radio to satellite, cellular or a Wi-Fi modem to an operation center. The lock may transmit data periodically to the operation center, which can track and monitor the state of the container.

In another embodiment, a system comprises a network of sensors inside a cargo container, each sensor capable of generating sensor information pertaining to the environment within the cargo container; an operation center; and a device outside of the cargo container capable of communicating with the network of sensors and with the operation center, capable of receiving the sensor information from the network of sensors, and capable of reporting a message based on the sensor information to the operation center. One sensor in the sensor network may include one of a temperature sensor, a humidity sensor, a radioactivity sensor, a chemical/biological toxin sensor, a chemical explosive sensor, a vibration sensor, a sound sensor, a collision sensor, and a light sensor. The device may include a lock. The lock may include a secure hasp and a hasp integrity monitor for monitoring the integrity of the secure hasp. The device may include a cellular network communication module for communicating with the operation center, or a satellite communication module for communicating with the operation center. The device may include a wireless communication module for communicating with the network of sensors. The network of sensors may be capable of intercommunication, and at least one sensor may communicate indirectly with the device. The device may include in-device sensors. The device may include a communication module capable of communicating with other device on other containers. The cargo container may be near another cargo container having another device capable of communicating with the operation center, and the device may communicate with the operation center indirectly via the other device on the other container. The device may communicate with the sensor network using encryption. The device may communicate with the operation center using encryption. The operation center may monitor the message received from the device to determine a proper response. The sensor information may include sensor data and/or alarm-state information. The message may include the sensor information and/or sensor data.

In another embodiment, a method comprises obtaining sensor information from a sensor inside a cargo container, the sensor information related to the environment within the cargo container; and sending the sensor information to an operation center.

In another embodiment, a system comprises a sensor communication module for communicating with a sensor disposed inside a cargo container, the sensor being capable of generating sensor information related to the environment within the cargo container; and an operation center communication module capable of sending a message based on the sensor information to an operation center.

DETAILED DESCRIPTION

The following description is provided to enable any person skilled in the art to make and use the invention, and is provided in the context of a particular application and its requirements. Various modifications to the embodiments are possible to those skilled in the art, and the generic principles defined herein may be applied to these and other embodiments and applications without departing from the spirit and scope of the invention. Thus, the present invention is not intended to be limited to the embodiments shown, but is to be accorded the widest scope consistent with the principles, features and teachings disclosed herein.

In one embodiment, a smart lock may facilitate locking and tracking of a container using wired or wireless sensor devices to monitor the state of the container, including the detection of container door tampering, undesirable temperature and humidity inside the container, accelerations and vibrations of the container, a variety of gas emissions and radiation, etc. Each sensor may be sensitive enough to detect problems anywhere inside the container. Additionally, the lock may receive GPS/Gallileo/Glosnass information and thus may maintain precise location information. The smart lock may determine when alarm conditions exist and may send encrypted data via low-powered radio to satellite, cellular or a Wi-Fi modem to an operation center. The lock may transmit data periodically to the operation center, which can track and monitor the state of the container.

Figure 1:
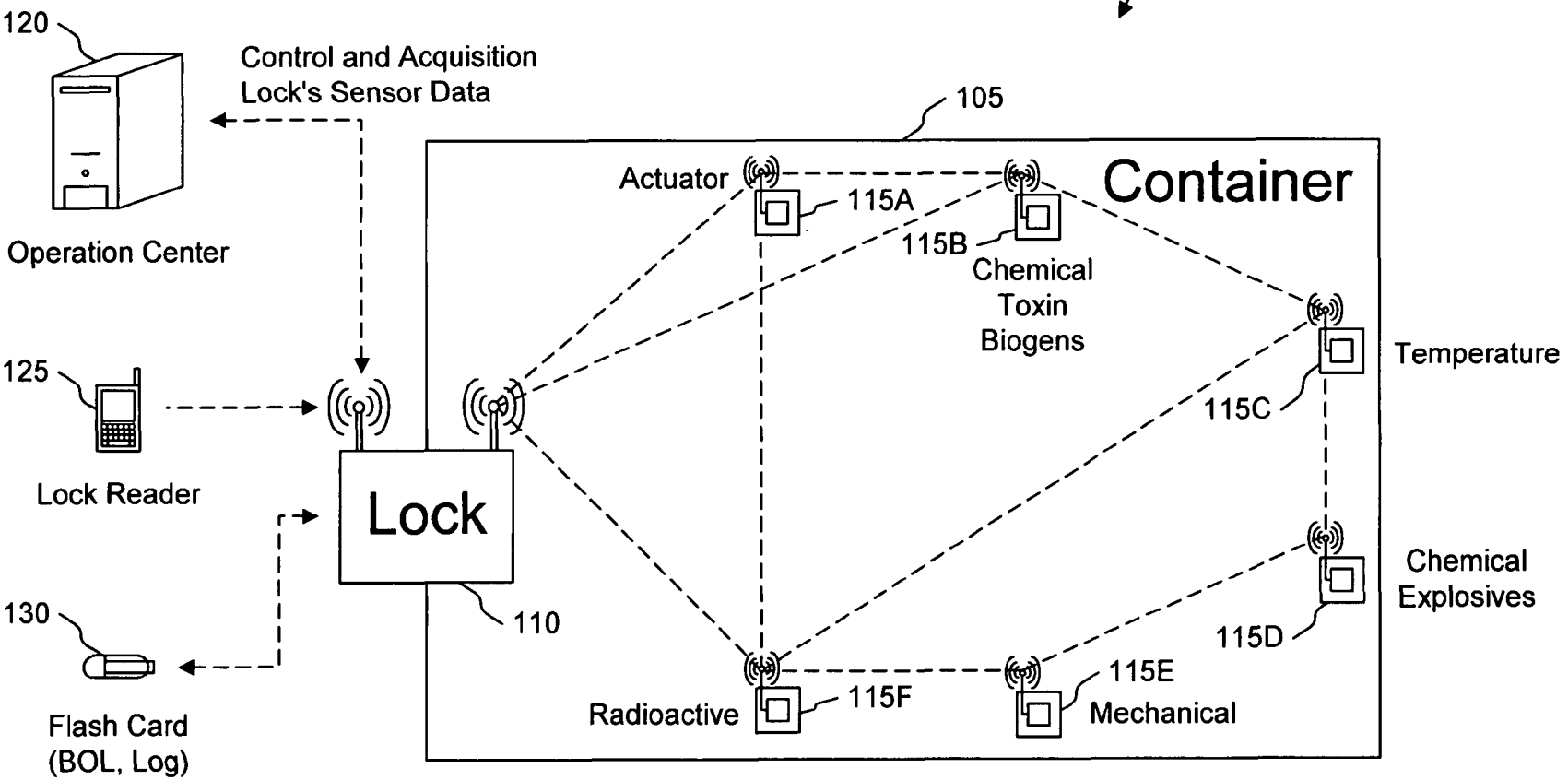
FIG. 1 is a diagram illustrating a cargo container security network in accordance with an embodiment of the present invention.

FIG. 1 is a diagram illustrating a cargo container security network 100, in accordance with an embodiment of the present invention. Cargo container security network 100 includes a secure container 105 having a lock 110 in communication with an arrangement of sensors, e.g., an actuator 115*a* (to monitor for shock/acoustic events), a chemical/biological toxins sensor 115*b* (to monitor for harmful chemical/biological substances), a temperature sensor 115*c* (to monitor for temperature changes, a hot threshold or a cold threshold), a chemical explosives sensor 115*d* (to monitor for chemical explosive substances), a mechanical sensor 115*e* (to monitor for vibration), a radioactivity sensor 115*f* (to monitor for radioactive substances), etc. Sensors 115*a-f* may be referred to herein as the sensor network 115. Sensor network 115 may include one sensor of one type (e.g., temperature), multiple sensors of various types (e.g., temperature and chemical/biological toxins), one sensor that manages multiple types, etc. The sensor network 115 may include multiple sensors of the same type, e.g., for redundancy or increasing the sense area. The sensor network 115 may include sensors of other types, e.g., a humidity sensor, a light sensor, ultrasound, radio frequency signals, quantum entanglement, etc. Sensors may be added at any time or as they are developed. Additional details about the lock 110 are shown and described with reference to FIGS. 2, 3 and 4.

Each of the sensors 115*a*-115*f* may be in direct or indirect communication with the lock 110. In this embodiment, the sensors are placed in a mesh-type network, such that each sensor 115*a*-115*f* in the network 115 may receive and forward messages from other sensors 115*a*-115*f* in the network 115 onward to the lock 110. In one embodiment, the lock 110 may interrogate the sensors 115*a*-115*f* periodically, at set times, upon receiving an instruction, etc. Alternatively, the sensors 115*a*-115*f* may be configured to send periodic messages, continuous messages, etc. to the lock 110. A sensor 115*a*-115*f* reports sensor data, e.g., temperature, radiation levels, etc., or may send an alarm-state, e.g., an indication whether the sensor is within or without proper thresholds. The lock 110 may interpret sensor data against thresholds to determine an alarm-state, and may provide the alarm-state to the operation center 120 or to others. The alarm-state may have varying degrees, e.g., green, yellow, red. In one embodiment, the lock 110 interprets the lack of a message from one of the sensors 115*a*-115*f* as a failure of the device. The lock and the sensor network 115 may operate using radio frequency communication.

The lock 110 may report messages from the sensor network 115 to the operation center 120, possibly using cellular or satellite communication techniques. The message may include the sensor data, the alarm-state of the lock 110, etc. to the operation center 120. The operation center 120 may interpret the lack of a message from a lock 110 as a failure of the lock or as possible tampering event. In another embodiment, the lock 110 may forward the sensor data (including lack of sensor data), without an alarm-state, to allow the operation center 120 or others to determine the alarm-state. In another embodiment, the lock 110 may send the alarm-state without the sensor data. The operation center 120 can be staffed by a group that monitors the sensor networks 115 of the cargo containers 105 on various transport vessels over the world, heading into the U.S., within the U.S., etc. The operation center 120 may operate to dispatch investigative bodies (e.g., Department of Homeland Security, U.S. Customs, the Coast Guard, security guards, transport vessel personnel, etc.) to check on problems, e.g., alarms, sensor failures, etc. Additional details about the operation center 120 are shown and described with reference to FIG. 5.

At check points or at any time, a security guard, Customs official, DHS official, ship captain, or other person can use a lock reader 125 to monitor the status of the locks 110, e.g., via a wireless connection. Further, a security guard, Customs official or other person can use a flash card (or other storage device) 130 to download the bill of lading, log, monitoring reports, etc. from the lock 110. That way, the security guard, Customs official can review the information easily and can refer to it at a later time.

To add additional security, lock 110 and lock readers 125 may require entry of a user ID, password and secure token information, e.g., RSA SecurID number, etc. For example, the lock 110 may require entry of the user ID, password and secure token information before information can be loaded onto the lock 110, information can be downloaded from the lock 110, the lock 110 can be initiated, the lock 110 can be opened, etc. Messages from sensor network 115 to the lock 110 and messages from the lock 110 to the operation center 120 may be encrypted using public/private key cryptography and/or digital certificates. That way, the operation center 120 can make the configuration of locks 110 by unauthorized personnel more difficult.

Figure 2:
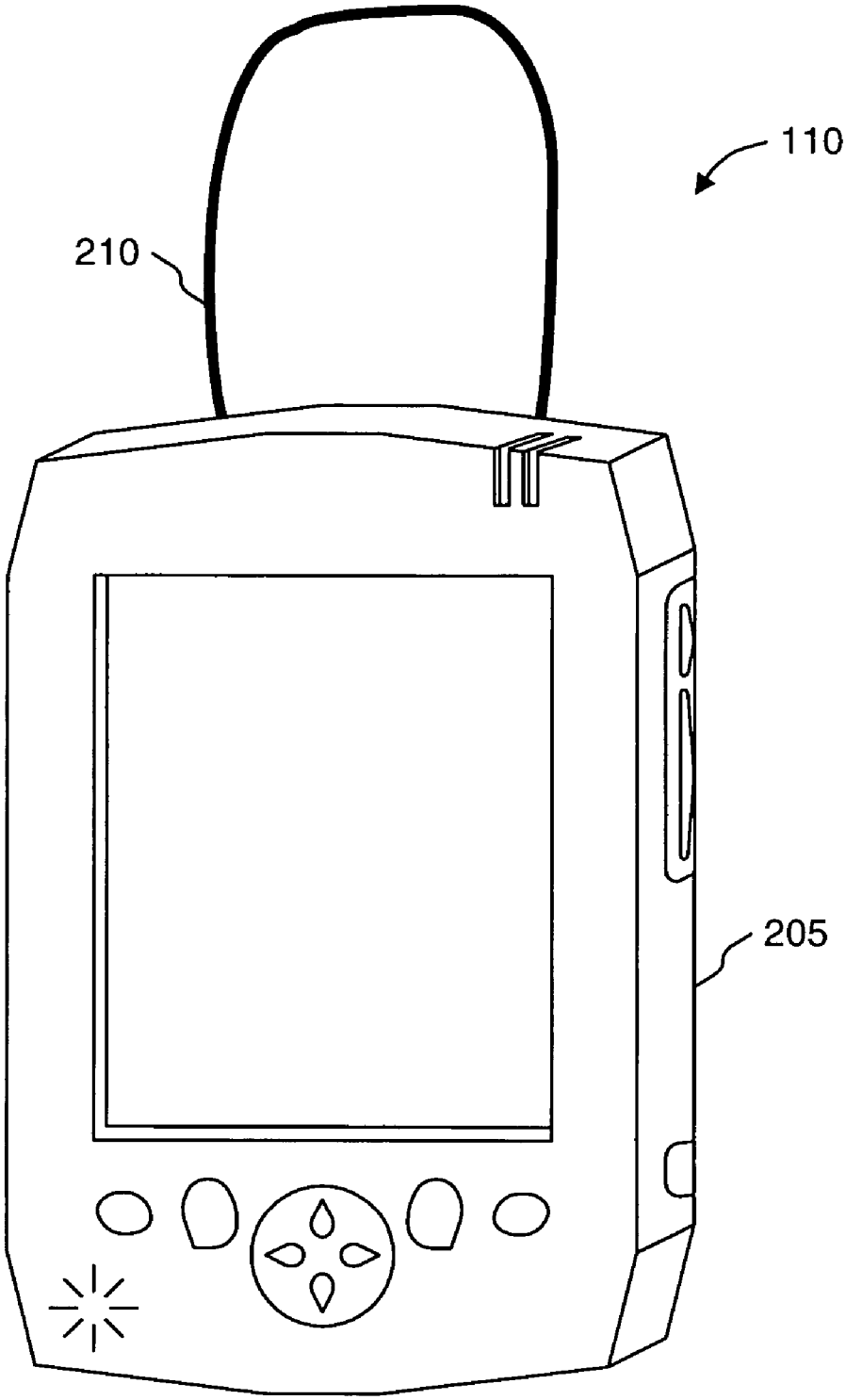
FIG. 2 is a diagram illustrating an example lock, in accordance with an embodiment of the present invention.

FIG. 2 is a diagram illustrating an example lock 110, in accordance with an embodiment of the present invention. Example lock 110 includes a ruggedized pocket-type computer 205 with a secure hasp 210. The pocket-type computer 205 may include a user interface for initiating the lock 110, configuring the lock 110, loading information onto the lock 110, downloading information from the lock 110, etc. The pocket-type computer 205 may monitor that the secure hasp 210 remains secure and locked, e.g., using an electrical cable or fiber-optic bundle. If not, the pocket-type computer 205 may send an alarm-state message to the operation center 120 or to a local lock reader 125 to expose the possible security breach. Details of the example lock 110 are shown and described with reference to FIGS. 3 and 4.

Figure 3:
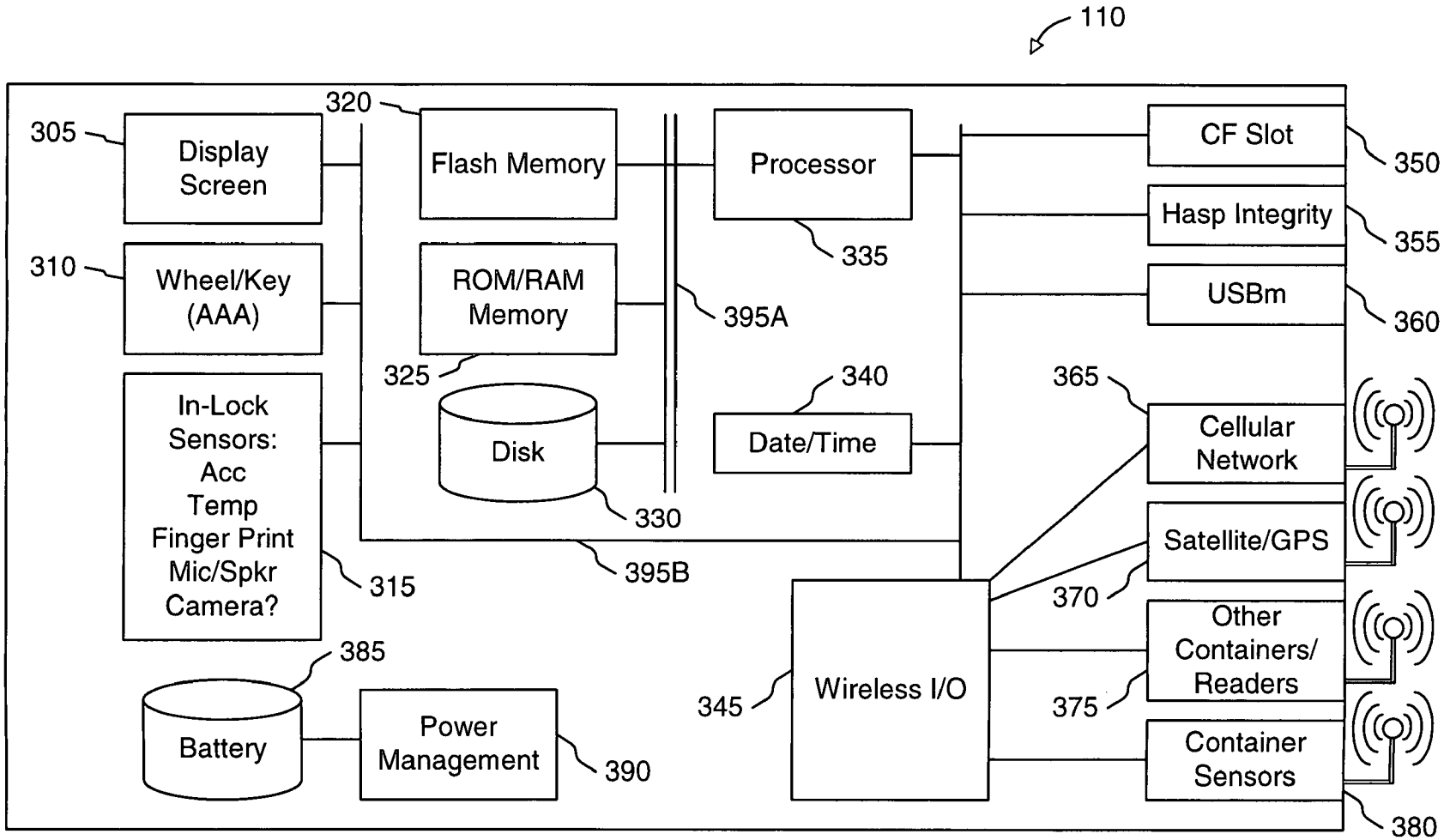
FIG. 3 is a block diagram illustrating example details of the example lock of FIG. 2.

In one embodiment, the lock has the following specifications:

Authentication, Authorization, Accountability (AAA): SecureID, EAP Protocol
License Security: 1024 bit AES dynamic key allocation
Storage: 2 GBytes Flash—Holds approximately a 10-year log
Battery Life: 5 years, when fully charged
Power Management: Opportunistic
Dimensions: 6"×4"×1.5" (153×102×37 mm)
Weight: 500 g (1 lb)
Disk Drive: 20 GB FIG. 3 is a block diagram illustrating details of the example lock 110 of FIG. 2. Example lock 110 includes flash memory 320, ROM/RAM memory 325, disk storage 330 and a processor (e.g., Intel Xscale) 335, each coupled to a first bus 395*a*. The lock 110 further includes a display screen 305, a wheel/key (AAA) 310, internal sensors (e.g., acceleration, temperature, fingerprint, microphone, speaker, camera, etc.) 315, a date/time module 340, a wireless I/O module 345, a compact flash slot 350, a hasp integrity module 355, and a USBm slot 360, each coupled to a second bus 395*b* (e.g., the I2C bus). The processor 335 may also be coupled to the second bus 395*b*. The wireless I/O module 345 may be coupled to a variety of wireless communication modules, e.g., a cellular network communication module 365, a satellite/GPS module 370, other containers/readers communication modules 375, and container sensor communication modules 380. The lock 110 may further include a battery 385 and power management circuitry 390.

The wheel/key 310 may enable the user to input user ID, password, secure token information, etc. The flash memory 320 may store a log for the lock 110, e.g., sensor data, alarms, failures, etc. The ROM/RAM memory 325 may store program code for operating the functions and features of the lock 110. Example program code is shown and described with reference to FIG. 4. The compact flash slot 350 or USBm slot 360 enable users (e.g., Customs officials, security guards, etc.) to insert a compact flash or USB drive to upload or download information. The hasp integrity module 355 may direct current through the hasp 210 or monitor for stress on the hasp 210 to determine if it is cut.

The wireless I/O module 345 may convert the various wireless formats and protocols (e.g., 802.15.3, GPS, cellular, RFID, Bluetooth, etc.) received to a standard message format and protocol.

The cellular network communication module 365 may be used to communicate with the operation center 120 and/or lock readers 125. Alternatively, the satellite/GPS module 370 may be used to communicate with the operation center 120 and/or lock readers 125. Other protocols and formats for communicating with the operation center 120 and/or lock readers 125 e.g., WiFi, may be used. In one embodiment, the lock 110 may use the cellular network communication module 365 when available (since cellular is cheaper) and the satellite/GPS communication module 370 when cellular is not available. The satellite/GPS module 370 may include an inertial recognition module (not shown) to assist with location identification, e.g., when GPS is unavailable.

The other containers/readers communication module 375 may be used to communicate with other containers and readers 125, e.g., using Bluetooth, IEEE 802.15.3, IEEE 802.15.4, WiFi, or like wireless communication standard. For example, when cargo containers, e.g., containers 125, are loaded onto a large transport vessel, e.g., a cargo ship, one or more containers may be buried beneath several other containers. Each container and the products therein on top of a buried container may reduce the strength of messages being sent by the lock 110. Accordingly, each lock 110 may include a communication module 375 that is capable of communicating with other locks 110. That way, a buried container can send a signal through the network of locks 110 to a lock 110 that can communicate with a lock reader 125 and/or with the operation center 120.

The container sensors 380 may be used to communicate with the sensors 115*a*-115*f* of the sensor network 115, e.g., using the formats and protocols defined by IEEE 802.15.3 or 802.15.4 (commonly referred to as the ZigBee protocol). ZigBee is a published specification of high level communication protocols designed to use small, low-power digital radios for wireless personal area networks (WPANs). Other protocols and formats, e.g., Bluetooth, WiFi, etc., for communicating with the sensors 115*a*-115*f* may alternatively or additionally be used.

Figure 4:
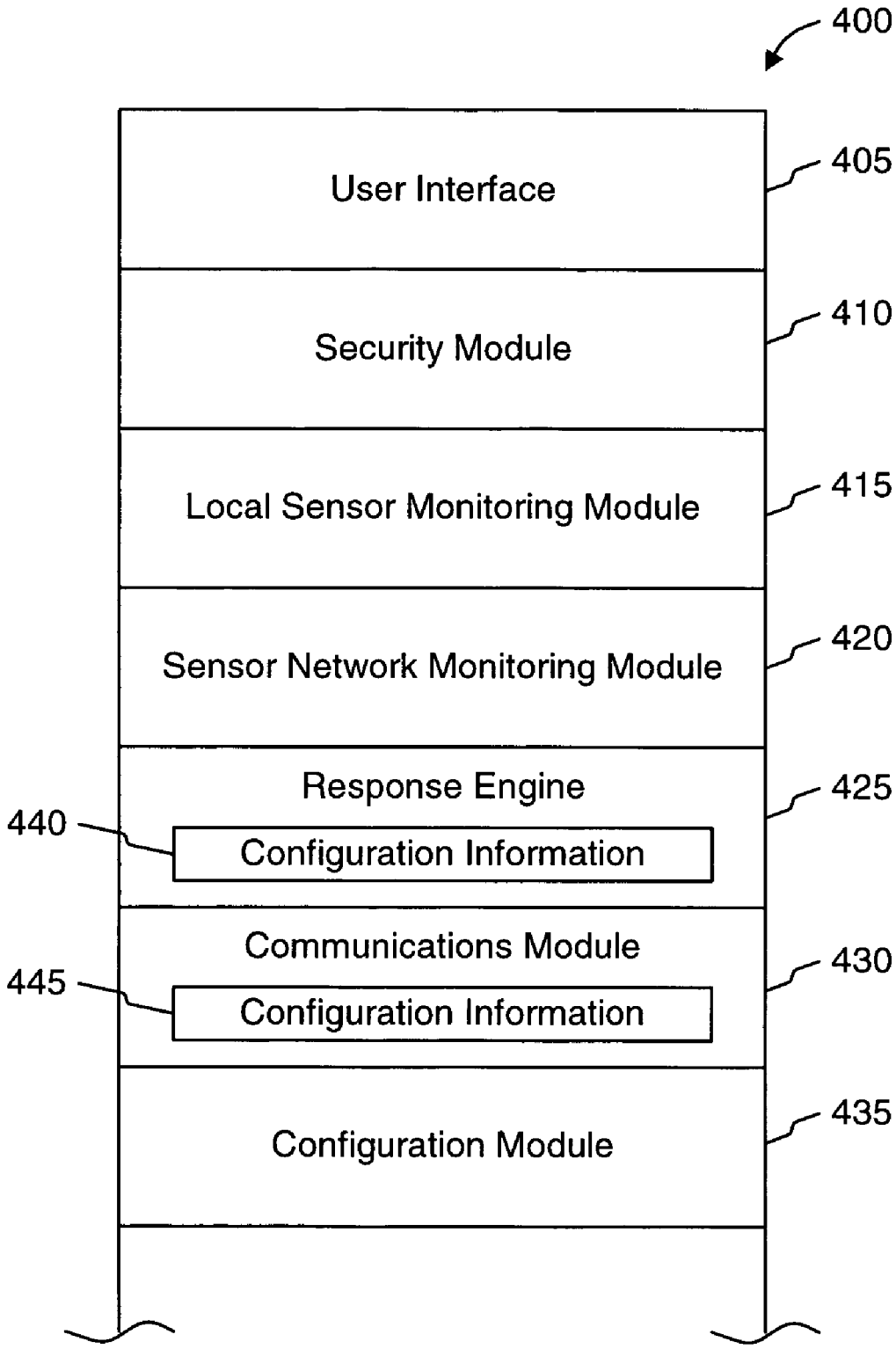
FIG. 4 is a block diagram illustrating details of example program code of the example lock of FIG. 3.

FIG. 4 is a block diagram illustrating example program code 400, in accordance with an embodiment of the present invention. Program code 400 includes a user interface 405, a security module 410, a local sensor monitoring module 415, a sensor network monitoring module 420, a response engine 425, a communications module 430, and configuration module 435.

The user interface 405 includes program code for enabling a user to login, logout, lock, unlock, upload information, download information, present status information, etc. The user interface may include wheel/key 310 control, display screen 305 control, etc.

The security module 410 includes program code for reviewing user ID, password, secure token information, etc. The security module 410 may disable features, unless the user ID, password, secure token information, etc. are validated. For example, the security module may disable locking and unlocking, information downloading, information uploading, etc.

The local sensor monitoring module 415 includes program code for monitoring the in-lock sensors 315. Local sensor module 415 may apply wired or wireless communication standards.

The sensor network monitoring module 420 includes program code for monitoring the sensors 115*a*-115*f* of the sensor network 115, which may be in or around the container 105. The sensor network monitoring module 420 may include drivers for operating the container sensors communication module 380.

The response engine 425 includes program code for reviewing the messages received from the local sensor monitoring module 415 and from the sensor network monitoring module 420 and, based on configuration information 440, determines the proper response. For example, the response engine 425 may determine whether to send a message to the operation center 120, to one or more lock readers 125, etc.

The communications module 430 includes program code for communicating with the operation center 120 and/or lock readers 125, and program code for communicating with other containers/lock readers, etc. The program code for communicating with the operation center 120 and/or lock readers 125 may include a driver for controlling the cellular network communication module 365, a driver for controlling the satellite/GPS communication module 370, and drivers for communicating with other containers/readers 375. The communications module 435 may include configuration information 445, e.g., public/private keys, digital certificates, encryption protocols, etc.

The configuration module 435 includes program code for configuring the lock 110, e.g., obtaining the configuration information 440, obtaining configuration information 445, etc.

Figure 5:
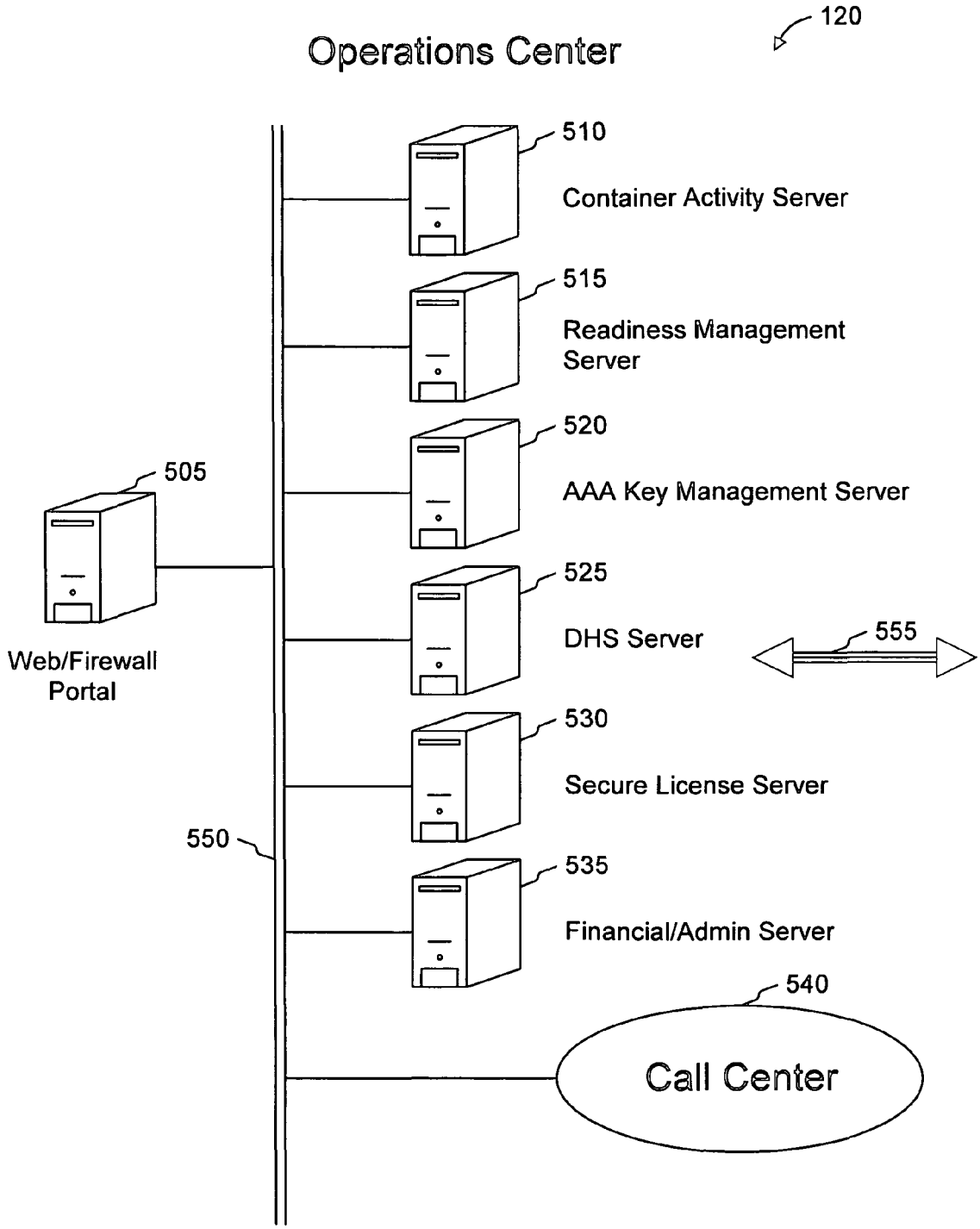
FIG. 5 is a block diagram illustrating details of an operation center of FIG. 1.

FIG. 5 is a block diagram illustrating details of an operation center 120. Operation center 120 includes a web/firewall portal 505, a container activity server 510, a readiness management server 515, a AAA key management server 520, a DHS server 525, a secure license server 530, a financial/administrative server 535, and a call center 540, each connected to a server backbone 550.

The container activity server 510 monitors container activity, e.g., sensor data, alarm-state messages, failure messages, geographic location information, initialization activity, upload events, download events, etc. The container activity server 510 stores the activity messages in a database.

The readiness management server 515 obtains the container activity, and based on the activity initiates security responses. The readiness management server 515 may learn from past events and responses, which events require a security response, which require extra monitoring, which can be ignored, etc. For example, a failure message may merit DHS to send a team to check the container. Alternatively, the readiness management server 515 may send a request to a Customs official at the next checkpoint to check the container 105 or replace the defective sensor 115*a*-115*f*. The readiness management server 515 may respond to different alarm-states based on the circumstances. For example, the readiness management server 515 may learn that spoiling bananas generate minor radioactivity. Thus, in a container 105 known to include bananas, the readiness management server 515 may identify the container 105 for additional monitoring, but not request any person to check the container 105. In another container 105 that does not include bananas, it may immediate dispatch a response team.

The AA key management server 520 confirms secure token information for all locks 110.

The DHS management server 525 communicates directly with the Department of Homeland Security (DHS), possibly across a dedicated communication channel 555. The DHS management server 525 may inform the DHS of the state of all containers 105, of all alarm-state messages, of all failure messages, and/or the like.

The secure license server 530 confirms that communications from locks 110 contain proper certificates, public/private key encryption, etc.

The financial/administrative server 535 handles administrative tasks such as billing, accounting, subscriptions, etc.

The call center 540 handles telephone, email, IM, etc. communications with subscribers, captains, DHS, Coast Guard officials, etc. For example, if a ship captain receives a concerning alarm-state message, then the ship captain can call the call center 540 to inquire whether anything needs to be done, to confirm that they received the message, to request response instructions, etc.

Figure 6:
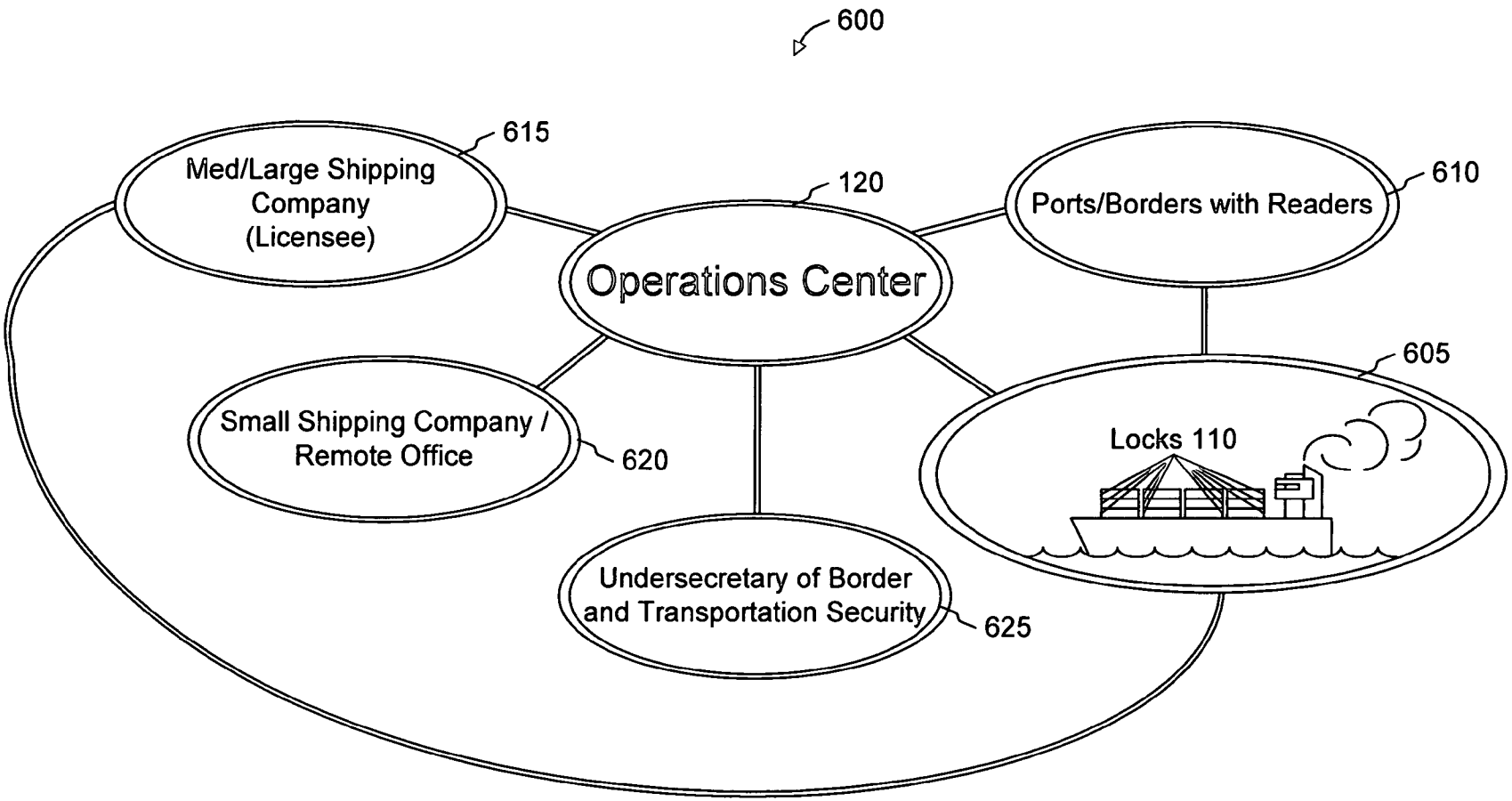
FIG. 6 is a diagram illustrating details of a cargo container security network, in accordance with another embodiment of the present invention.

FIG. 6 is a diagram illustrating details of a network architecture 600, in accordance with an embodiment of the present invention. Network architecture 600 includes an enterprise operations center 120 which communicates with locks 110 on transport vessels 605, with readers 125 at ports/borders 610, with medium/large shipping companies 615, with small shipping companies 620, and with the Undersecretary of Border and Transportation Security 625. The operations center 120 may enable 24/7 monitoring, certified loading of containers 105, continuous monitoring of lock 110 status, certified checkpoints, certified unloading at the final destination, etc.

Ports/borders personnel at ports/borders 610 may have readers 125 to monitor the state of the containers 105. Using the readers 125, flash memory 130, etc., the ports/borders personnel can determine what is in each of the containers 105, can organize loading and offloading for convenience, and can report any suspicious readings, etc.

Medium/large shipping companies 615 can become licensees of the enterprise to obtain direct monitoring equipment for directly monitoring their containers 105. For example, a strawberry producer may wish to monitor their strawberry shipments for vibration, temperature variances, collision events, etc. That way, the medium/large shipping companies 615 can respond by lower/raising temperatures, contracting with the transport companies to pay for damages caused by them, etc. The small shipping companies 620, who may not be licensees of the enterprise, may obtain similar information by communicating with the enterprise operation center 120.

Embodiments of the present invention may enable transmission of notarized manifests and shipper IDs to the operations center 120 at time of loading, with lookup in no-ship databases; container 105 location, lock 110 status and transfers monitored remotely by authorized agents; transmission of alarms to the operations center 120 for presence of humans, explosives and other forbidden cargo; monitoring of unauthorized unlock or removal of container doors; sending of silent alerts by the operations center 120 to authorities for suspicious containers; unlocking of containers 105 controlled remotely with an encrypted key; easy identification of unsecured containers 105; monitoring of empty containers on return trips, etc.

Figure 7:
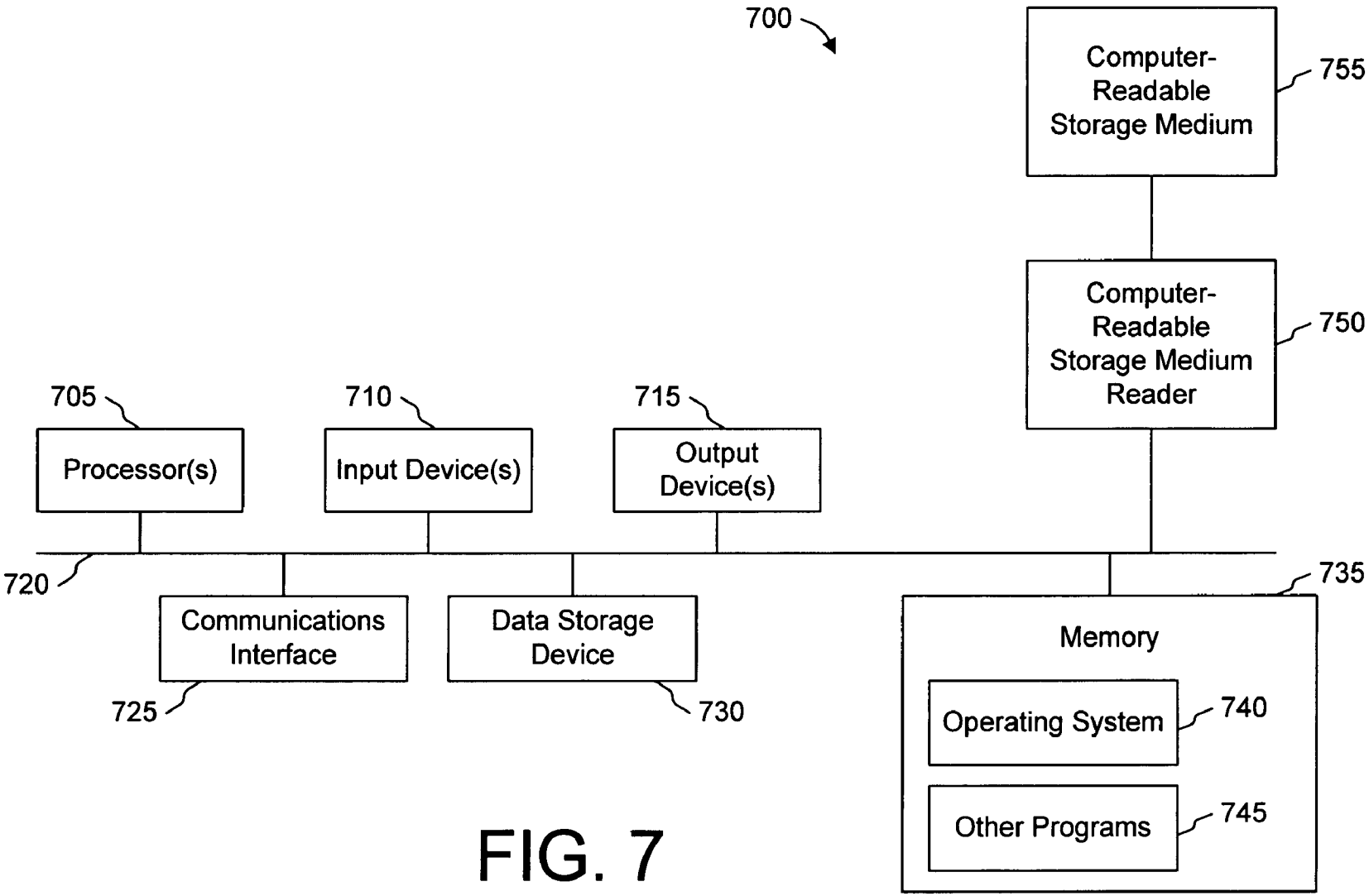
FIG. 7 is a block diagram illustrating details of a computer system.

FIG. 7 is a block diagram illustrating details of a computer system 700, of which lock 110, lock 125 or each server 505-545 may be an instance. Computer system 700 includes a processor 705, such as an Intel Pentium® microprocessor or a Motorola Power PC® microprocessor, coupled to a communications channel 720. The computer system 700 further includes an input device 710 such as a keyboard or mouse, an output device 715 such as a cathode ray tube display, a communications device 725, a data storage device 730 such as a magnetic disk, and memory 735 such as Random-Access Memory (RAM), each coupled to the communications channel 720. The communications interface 725 may be coupled to a network such as the wide-area network commonly referred to as the Internet. One skilled in the art will recognize that, although the data storage device 730 and memory 735 are illustrated as different units, the data storage device 730 and memory 735 can be parts of the same unit, distributed units, virtual memory, etc.

The data storage device 730 and/or memory 735 may store an operating system 740 such as the Microsoft Windows XP, Linux, the IBM OS/2 operating system, the MAC OS, or UNIX operating system and/or other programs 745. It will be appreciated that a preferred embodiment may also be implemented on platforms and operating systems other than those mentioned. An embodiment may be written using JAVA, C, and/or C++ language, or other programming languages, possibly using object oriented programming methodology.

One skilled in the art will recognize that the computer system 700 may also include additional information, such as network connections, additional memory, additional processors, LANs, input/output lines for transferring information across a hardware channel, the Internet or an intranet, etc. One skilled in the art will also recognize that the programs and data may be received by and stored in the system in alternative ways. For example, a computer-readable storage medium (CRSM) reader 750 such as a magnetic disk drive, hard disk drive, magneto-optical reader, CPU, etc. may be coupled to the communications bus 720 for reading a computer-readable storage medium (CRSM) 755 such as a magnetic disk, a hard disk, a magneto-optical disk, RAM, etc. Accordingly, the computer system 700 may receive programs and/or data via the CRSM reader 750. Further, it will be appreciated that the term "memory" herein is intended to cover all data storage media whether permanent or temporary.

Figure 8:
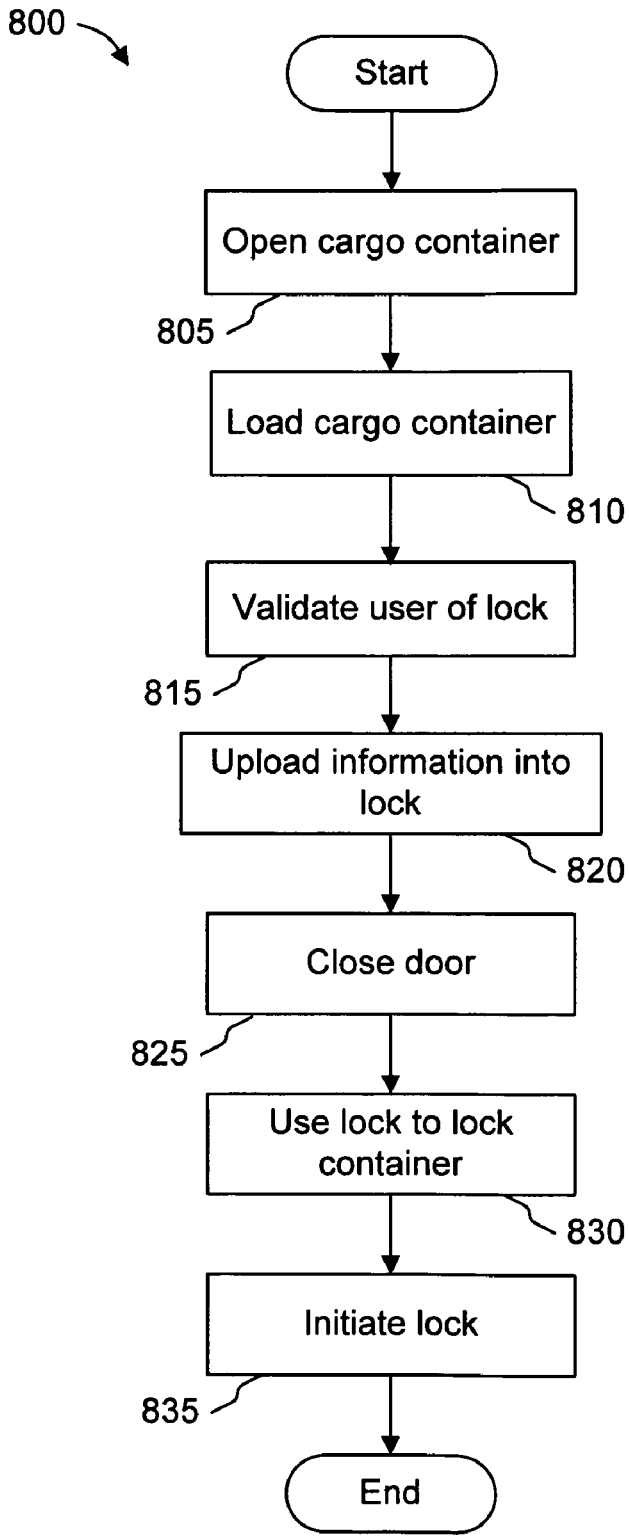
FIG. 8 is a flowchart illustrating a method of loading and locking a container, in accordance with an embodiment of the present invention.

FIG. 8 is a flowchart illustrating a method 800 of loading and locking a container 105, in accordance with an embodiment of the present invention. Method 800 begins in step 805 with the opening of a cargo container 105. In step 810, the cargo container 105 is loaded, possibly under the supervision of enterprise personnel. In step 815, the authorized user validates himself possibly using user ID, password and a secure token. In step 820, the authorized user uploads information into the lock 110. The information may include configuration information, bill of lading information, etc. In step 825, the door to the cargo container 105 is closed. In step 830, the cargo doors are locked using the lock 110. In step 835, the lock 110 is initiated to begin sending encrypted messages, possibly to the operation center 120, to other officials using lock readers 125, and/or to others.

Figure 9:
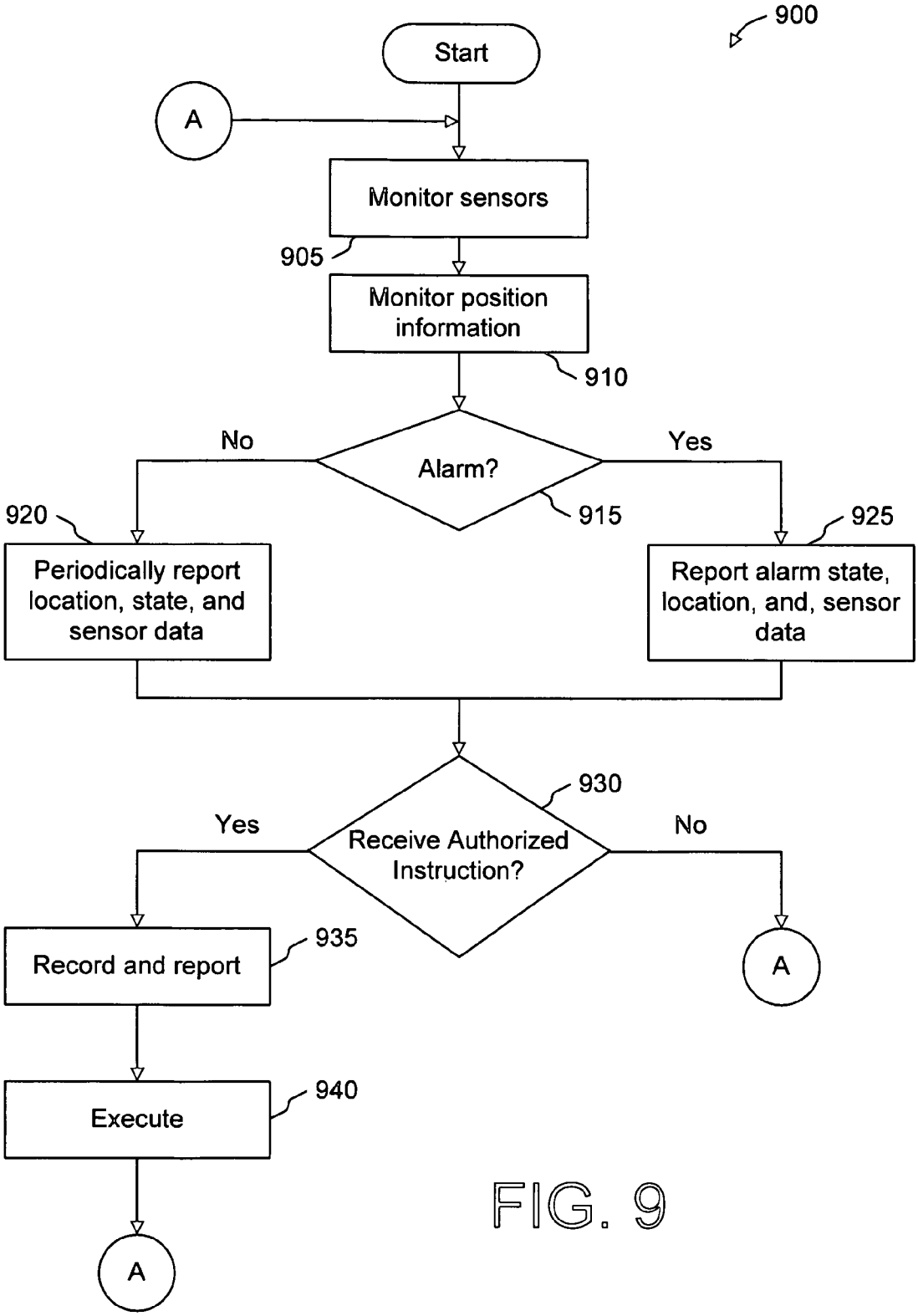
FIG. 9 is a flowchart illustrating a method of monitoring sensors in or near the cargo container and/or authorized instructions, in accordance with an embodiment of the present invention.

FIG. 9 is a flowchart illustrating a method 900 of monitoring sensors in or near the cargo container 105 and/or authorized instructions from the operations center 120 or other authorized person, in accordance with an embodiment of the present invention. Method 900 begins in step 905 with the lock 110 monitoring sensors in or near the cargo container 105. The sensors may include in-lock sensors, e.g., sensors 315, or in-container sensors, e.g., sensors 115*a*-115*f*. In step 910, the lock 110 monitors the position of the lock 110, and thus the container 105, e.g., using GPS, Glosnass, etc. In step 915, the lock 110 determines if an alarm, e.g., sensor data has been received outside a given threshold, damage to the lock 110, cutting of the secure hasp 210, etc. has occurred. If not, then the lock 110 in step 920 periodically reports the location of the lock 110, state of the lock 110 and sensor data, e.g., to the operation center 120, to the lock readers 125, to DHS, etc. If an alarm has occurred, the lock 110 in step 925 immediately reports the alarm, location and sensor data, e.g., to the operation center 120, to the lock readers 125, to DHS, etc. In step 930, the lock determines if it has received an authorized instruction, e.g., a remote unlock instruction. The lock 110 may determine if the instruction is authorized using public/private key cryptography, digital certificates, secure token information, etc. If not, then method 900 returns to step 905 to continue monitoring. If so, then the lock 110 in step 935 records and reports the instruction, e.g., to the operation center 120, to the lock readers 125, to DHS, etc. Then, the lock 110 executes the instruction, e.g., unlocks the doors. Then, method 900 returns to step 905 to resume monitoring.

Figure 10:
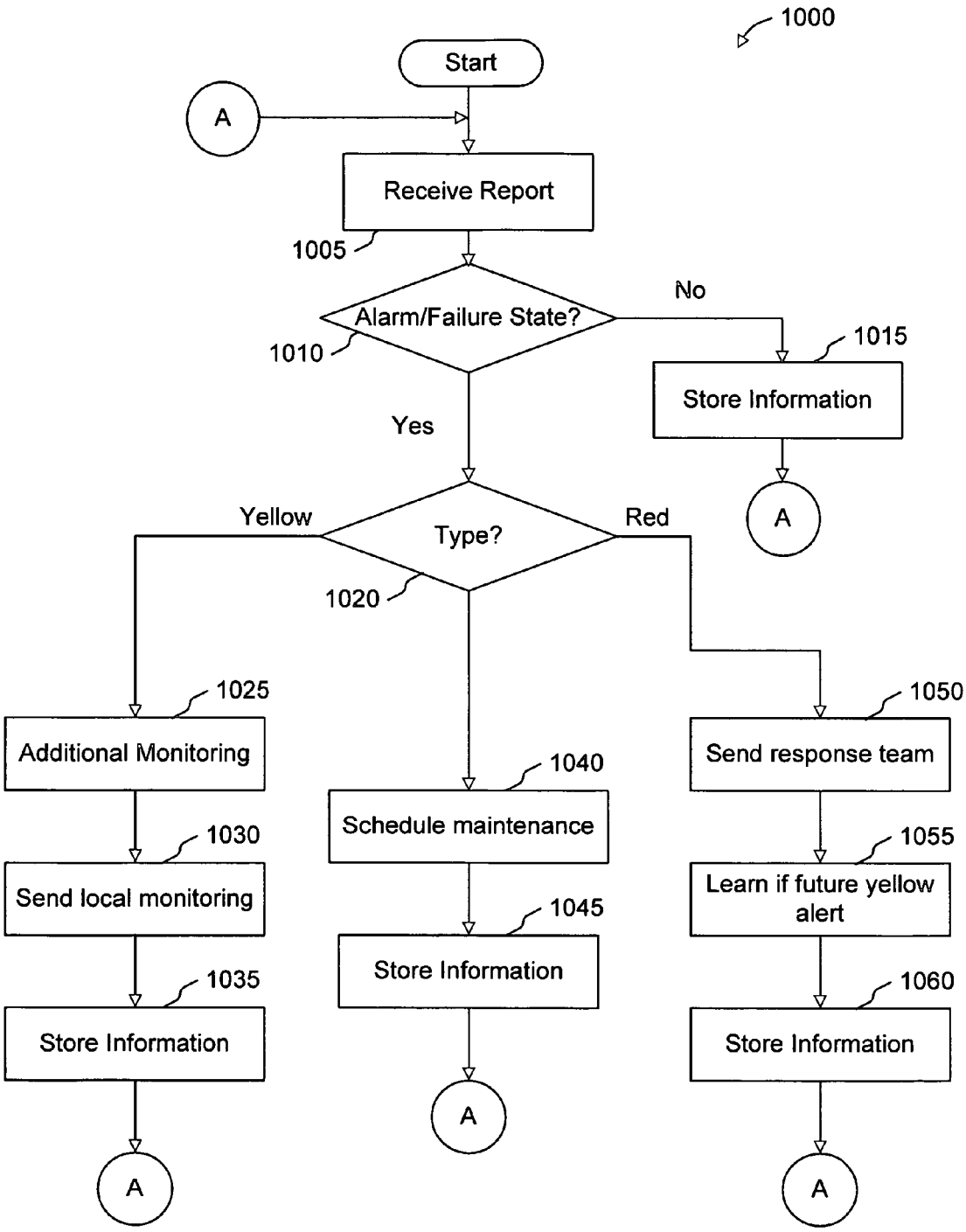
FIG. 10 is a flowchart illustrating a method of monitoring locks by an operation center, in accordance with an embodiment of the present invention.

FIG. 10 is a flowchart illustrating a method 1000 of monitoring locks 110 by an operation center 120, in accordance with an embodiment of the present invention. Method 1000 begins in step 1005 with the operation center 120 receiving a report from a lock 110. In step 1010, the operation center 120 determines if the report indicates an alarm and/or failure state. If not, then the operation center 120 in step 1015 stores the information. Method 1000 then returns to step 1005 to receive another report. If the operation center 120 determines that the report includes an alarm and/or failure state, then the operation center 120 in step 1020 determines the type of alarm/failure state.

If the report includes a yellow alert, then the operation center 120 in step 1025 initiates additional monitoring of the cargo container 105, e.g., increases the periodicity of reports. In step 1030, the operation center 120 sends local personnel to physically monitor the container 105. In step 1035, the operation center 120 stores the information. Method 1000 then returns to step 1005 to receive another report.

If the report includes a red alert, then the operation center 120 in step 1050 immediately dispatches a response team to view the cargo container 105. The response team may include local personnel and/or officials of the DHS and/or Hazmat and/or others. The operation center 120 in step 1055 may learn whether the circumstances surrounding the red alert should in the future be deemed a yellow alert or a non-alert situation. In step 1060, the operation center 120 stores the information. Method 1000 then returns to step 1005 to receive another report.

If the report includes a failure alert, then the operation center 120 in step 1040 schedules maintenance. Maintenance can occur immediately by local personnel, can occur at the next checkpoint, can occur after delivery of the container 105, etc. The operation center 120 in step 1045 stores the information. Method 1000 returns to step 1005 to receive another report.

Although method 1000 is being described as performed by operation center 120, one skilled the art will recognize the any authorized person or entity can conduct method 1000.

Although the systems herein have been described as using a lock 110, one skilled in the art will recognize that the systems can be implemented with a non-locking apparatus. In one embodiment, the apparatus may include a self-contained, portable unit, which includes the sensor communications means to sensors in a container. The apparatus has operation center communication means for communicating with the internet or a network to send messages to an operations center. The sensor communication means may be bidirectional, so that the apparatus can send messages to the sensors including program updates, commands, sensor thresholds for alert reporting, timing updates, sensor network address tables for mesh applications, and encryption key changes. The sensors can send to the apparatus messages including sensor status reports, battery condition, out-of-limit high priority messages, error reports on communications with neighboring sensors. For recognition reasons, each sensor unit may have a unique identifier, e.g., a network address. The communications means between the lock and the sensors can be wired or wireless, including but not limited to the wireless protocol of Bluetooth, IEEE 802.15, Zigbee. The sensor may begin sensing in response to a predetermined event.

Although the embodiments above have been described as having a lock 110 on the outside of the container 105, one skilled in the art will recognize that the lock 110 may be on the inside of the container 105. If mounted on the inside of the container 105, in one embodiment, antennas, light indicators, solar charges, etc. may protrude to the outside. Other embodiments are also possible.

The foregoing description of the preferred embodiments of the present invention is by way of example only, and other variations and modifications of the above-described embodiments and methods are possible in light of the foregoing teaching. Although the network sites are being described as separate and distinct sites, one skilled in the art will recognize that these sites may be a part of an integral site, may each include portions of multiple sites, or may include combinations of single and multiple sites. The various embodiments set forth herein may be implemented utilizing hardware, software, or any desired combination thereof. For that matter, any type of logic may be utilized which is capable of implementing the various functionality set forth herein. Components may be implemented using a programmed general purpose digital computer, using application specific integrated circuits, or using a network of interconnected conventional components and circuits. Connections may be wired, wireless, modem, etc. The embodiments described herein are not intended to be exhaustive or limiting. The present invention is limited only by the following claims.

I claim:

1. A system, comprising:

a network of sensors inside a cargo container, each sensor capable of generating sensor information pertaining to the environment within the cargo container, the cargo container for receiving and storing merchandise;

an operation center configured to receive merchandise information associated with the merchandise stored in the cargo container; and a device outside of the cargo container capable of communicating with the network of sensors and with the operation center, capable of receiving the sensor information from the network of sensors, and capable of reporting a message based on the sensor information to the operation center, the message indicative of an alarm state triggered by the sensor information; and wherein the sensors in the network of sensors are capable of direct intercommunication;

the operation center determines a proper response to the alarm state based on the merchandise information, the proper response selected from a plurality of available responses; and one of the available responses includes ignoring the alarm-state based on the merchandise information.

2. The system of claim 1, wherein one sensor in the sensor network includes one of a collision sensor and a light sensor.

3. The system of claim 1, wherein the device includes a lock.

4. The system of claim 3, wherein the lock includes a secure hasp and a hasp integrity monitor for monitoring the integrity of the secure hasp.

5. The system of claim 1, wherein the device includes a cellular network communication module for communicating with the operation center.

6. The system of claim 1, wherein the device includes a satellite communication module for communicating with the operation center.

7. The system of claim 1, wherein the device includes a wireless communication module for communicating with the network of sensors.

8. The system of claim 1, wherein at least one sensor communicates indirectly with the device.

9. The system of claim 1, wherein the device includes in-device sensors.

10. The system of claim 1, wherein the device includes a communication module capable of communicating with other devices on other containers.

11. The system of claim 10, wherein the cargo container is near another cargo container having another device capable of communicating with the operation center, and wherein the device communicates with the operation center indirectly via the other device on the other container.

12. The system of claim 1, wherein the device communicates with the sensor network using encryption.

13. The system of claim 1, wherein the device communicates with the operation center using encryption.

14. The system of claim 1, wherein the sensor information includes sensor data.

15. The system of claim 1, wherein the message includes the sensor information.

16. The system of claim 1, wherein the sensor information includes the sensor data and the message includes alarm-state information.

17. A method comprising:

obtaining sensor information directly from a sensor network of sensors inside a cargo container with a device located outside of the cargo container, each sensor capable of generating sensor information related to the environment within the cargo container, the cargo container for receiving and storing merchandise;

sending a message to an operation center, the message indicative of an alarm state triggered by the sensor information;

providing the merchandise information to the operation center; and determining a proper response to the alarm state at the operation center based on the merchandise information, the proper response selected from a plurality of available responses; and wherein the sensors in the network of sensors are capable of direct intercommunication; and one of the available responses includes ignoring the alarm-state based on the merchandise information.

18. The system of claim 1, wherein each sensor is capable of independently generating sensor information pertaining to the environment within the cargo container.

19. The method of claim 17, wherein each sensor is capable of independently generating sensor information related to the environment within the cargo container.

* * * * *